US005372659A

United States Patent [19]

Lamaze et al.

[11] Patent Number: 5,372,659

[45] Date of Patent: Dec. 13, 1994

[54] ALLOYS OF REFRACTORY METALS SUITABLE FOR TRANSFORMATION INTO HOMOGENEOUS AND PURE INGOTS

[75] Inventors: Airy-Pierre Lamaze, Grenoble; Christophe Mennetrier, Ugine, both of France

[73] Assignee: Cezus-Compagnie Europeenne Du Zirconium, Courbevoie, France

[21] Appl. No.: 59,287

[22] Filed: May 11, 1993

[30] Foreign Application Priority Data

May 12, 1992 [FR] France ..... 92 06233

[51] Int. Cl.[5] ..... C22C 14/00; C22C 16/00; C22C 27/02

[52] U.S. Cl. ..... 148/421; 148/422; 75/255

[58] Field of Search ..... 420/422, 417, 425, 427; 75/255; 148/421, 422

[56] References Cited

U.S. PATENT DOCUMENTS

| | | | |
|---|---|---|---|
| 2,985,531 | 5/1961 | Gordon et al. | 420/422 |
| 3,515,543 | 6/1970 | Harlow et al. | 420/422 |
| 5,026,521 | 6/1991 | Kajimura et al. | 420/422 |
| 5,118,468 | 6/1992 | Boutin et al. | 420/422 |

FOREIGN PATENT DOCUMENTS

| | | | |
|---|---|---|---|
| 60-52538 | 3/1985 | Japan | 420/422 |

*Primary Examiner*—Deborah Yee

*Attorney, Agent, or Firm*—Dennison, Meserole, Pollack & Scheiner

[57] ABSTRACT

An alloy comprising at least two refractory metals having melting temperatures differing by at least 200° C., and being present in proportions by weight such that solidification begins at a temperature at least 150° C. less than the solidification temperature of the metal having the highest melting point. The alloy is produced by coelectrodeposition, and is in the form of conglomerates of dimensions between 0.2 and 30 mm of crystals of size 0.1 to 1 mm, in which the refractory metals are in a solid solution state.

5 Claims, 4 Drawing Sheets

ALLOYS OF REFRACTORY METALS SUITABLE FOR TRANSFORMATION INTO HOMOGENEOUS AND PURE INGOTS

BACKGROUND OF THE INVENTION

1. Field of the Invention

The present invention relates to alloys of refractory metals capable of being transformed into homogeneous and pure ingots, and to processes for producing these alloys.

More particularly, it relates to the alloys made from refractory metals having melting temperatures that differ by at least 200° C., such as hafnium-zirconium, hafnium-titanium, niobium-titanium, niobium-zirconium, tantalum-titanium, tantalum-zirconium, tantalum-niobium, niobium-tantalum-titanium, and niobium-titanium-aluminum.

More precisely, these alloys have compositions by weight such that the temperature at which solidification begins is less by at least 150° C. than the solidification temperature of the least meltable metal.

These alloys, initially produced in more or less divided form, are then subjected to at least one melting operation in order to convert them into ingots. The ingots may then be rolled in the form of sheets intended for manufacturing containers for reprocessing nuclear fuel, in the case of the Hf-Zr alloys, or neutron moderators in the case of Hf-Ti alloys, or superconductor compounds or aeronautical superalloys in the case of the Nb-Ti alloy.

2. Description of Related Art

It is known that such alloys can be produced by various processes, such as:

- coaluminothermics of oxides, which has the disadvantage of producing alloys that are contaminated with aluminum and oxygen and are in the form of solid blocks that must be crushed before being purified by electronic bombardment and converted into ingots;
- coreduction of chlorides by a metal such as sodium or magnesium, which leads to the formation of sponges that are highly polluted with the reducing agent and with iron and chlorine ions, and that also must be crushed;
- codeposition from the vapor phase, which produces highly pyrophoric whiskers that are hard to handle and must be compacted prior to melting;
- mechanosynthesis or cogrinding of the metals to be alloyed, which leads to particles of relatively coarse particle size that are also highly polluted, and which when melted result in a heterogeneous product because of the presence of unmelted residues of the least meltable metal.

SUMMARY OF THE INVENTION

The object of the invention is to produce alloys that have a homogeneous structure at the level of the elementary crystal, improved purity over that of the products of the prior art, and a suitable particle size so that they can be integrally melted and converted into ingots in which this homogeneity of structure and purity is maintained.

The invention thus relates to alloys of refractory metals capable of being converted into homogeneous ingots with a purity near 99.9%, formed from metals whose melting temperatures differ by at least 200° C. and whose proportions by weight are such that for each alloy, the temperature at which solidification begins is at least 150° C. less than the temperature of solidification of the least meltable metal. The alloys are in the form of conglomerates of dimensions between 0.2 and 30 mm and comprising crystals having a specific surface area of between 0.005 and 0.2 $m^2/g$, having a size of 0.1 to 1 mm, and in which the metals are in the solid solution state.

Accordingly, the alloys of the invention are characterized by crystals where the metals are in solid solution, that is, they are homogeneous on the atomic scale and at the very most have a relative compositional spacing of 20% with respect to the mean composition of the alloy, such that this homogeneity persists during the melting and lends the resultant ingots properties that are identical in every respect.

This is a major difference from the alloys made by melting of a mixture of constituents, where the unmelted residues form macroscopic zones that may reach several millimeters in size, and where major settling occurs, particularly when metals of quite different densities are involved.

In addition, these crystals and their conglomerates have a size and a specific surface area such that the problems of spontaneous oxidation, which occurs when this surface area is too large, or of shaping the products before melting when the size is too large are avoided, and such that dissolution in the molten metal is promoted.

Hence, these products are free of pollution with oxygen and iron, particularly during grinding operations, and it is possible to produce ingots of high purity by melting. Preferably, the crystals have a specific surface area of between 0.01 and 0.05 $m^2/g$ and the agglomerates have a dimension of between 1.5 and 12 mm, because it is within these ranges that the maximum homogeneities and purities are produced.

The invention also relates to processes for producing these alloys which are based on coelectrodeposition, that is, on the simultaneous electrolytic deposit of the elements forming the alloy. However, the technique of producing the alloy varies as a function of the potential difference in the deposit of each of the elements of the alloy.

A first technique is applicable to metals whose electrolytic deposit potentials differ very slightly from one another, that is, by less than 0.5 V, while a second technique relates to metals whose difference in deposit potentials is at least equal to 0.5 V.

In the first case, which more particularly relates to hafnium-zirconium alloys, the production process comprises using a pyrogenic electrolytic cell containing a bath of molten salts based on alkaline chlorides and at least one fluoride ion in a quantity by weight of between 1.5 and 5% of the weight of the bath, in which the following components are at least partly submerged: an electrode for measurement connected to a reference electrode, these electrodes serving to measure a monitoring potential for the electrolysis, an anodic assembly provided with a diaphragm based on carbon fibers and graphite, a cathode to which a continuous potential difference with respect to this assembly is applied, and an injector for injecting material to be electrolyzed along with inert gas. The process is characterized in that the metals are introduced simultaneously into the injector, in the form of gaseous chlorides in proportions corresponding to those of said alloy and in a quantity such that the molar ratio of the fluoride contained in the bath to the quantity of metals introduced will be between 2.5 and 15; the value of the monitoring potential, called the set-point potential, is noted; the metals are deposited onto the cathode in the form of an alloy while chlorides continue to be introduced into the injector in the desired proportion and in a quantity such that the potential measured at the monitoring electrode remains, in terms of absolute value, near the absolute value of the set-point potential.

Hence in the case where one seeks to produce alloys of metals whose deposit potentials differ by less than 0.5 V, the process consists in performing electrolysis in a cell equipped with a monitoring device.

Such a device has already been described in U.S. Pat. No. 4,567,643. By the choice of a ratio of fluoride to metal to be deposited, it is possible with great sensitivity to measure an electrical potential, which is a function of the concentration of the bath in terms of ions of this metal. Hence, once an optimum concentration has been determined, the potential that corresponds to it can be noted. This potential will then serve as a reference, and it suffices then to supply chloride to the cell in such a way as to keep this potential constant, in order to be sure of permanently having the desired concentration of dissolved metal ions in the bath.

The achievement of the invention is the discovery that this device can also be used in the case where one wishes to measure the concentration of a plurality of types of ions simultaneously. In this process, an anodic assembly is also used, provided with a particular diaphragm, as described in U.S. Pat. No. 5,064,513.

This diaphragm is constituted by carbon fibers embedded in a rigid graphite-based material, and it has the property of having a porosity of a predetermined value, which makes it easier to carry out the electrolysis and to produce a metal deposit with a regular structure.

Once again, the achievement of the invention is to demonstrate that these advantages are attained when a plurality of types of ions are used simultaneously.

The process also relates to an injector of the kind described in French Patent No. 2653139, whose effect is to keep the concentration by weight of the bath within a limited range and to adjust it progressively and precisely. This has the advantage in the present case of enabling easier control of the conditions under which a deposit is produced, where the proportions of the various metals must be within narrow limits.

The combination of these different means makes it possible to carry out the simultaneous electrolysis of a plurality of chlorides, and the simultaneous deposit of the metals of the alloy, in the desired proportions and in accordance with a structure meeting the characteristics of the invention.

However, this process is not applicable when the metals to be deposited have a difference in deposit potential near or equal to 0.5 V, as is the case, for example, with niobium-titanium alloys, because the process would produce a preferential deposit of the least electronegative metal and hence produces an alloy in which the elements are not in the desired proportions. It is accordingly necessary to utilize a variation of the process for producing these alloys.

Applicants have discovered that placing the most electronegative metal into solution in the bath not by means of electrolysis of its halide but rather by electrodissolution of the metal itself, using a sacrificial anode, achieves the desired result.

This leads to a process of producing alloys where a pyrogenic electrolytic cell is used containing a bath of molten salts based on alkaline chlorides and at least one fluoride ion in a quantity by weight of between 1 and 3% of the weight of the bath, in which the following elements are at least partly submerged: a monitoring electrode connected to a reference electrode, the electrodes serving to measure a monitoring potential, an anodic assembly provided with a diaphragm based on carbon fibers and graphite, a deposit cathode onto which a continuous potential difference E1 with respect to this assembly is applied, and an injector of material to be electrolyzed and inert gas. The process is characterized in that an electrode comprising the most electronegative metal of the alloy to be deposited and, via the injector, the halide of the most electropositive metal of the alloy to be deposited are introduced into the bath; a positive potential difference E2 is established between the sacrificial electrode and the injector, such that the metal of the electrode goes into solution in the bath; the concentrations of metal ions in the bath are adjusted so as to have a proportion in relation to that of the desired alloy and a quantity such that the molar ratio of the fluoride contained in the bath to the quantity of metals present is between 2.5 and 15; the value of the monitoring potential, known as the set-point potential, is noted; the metals are deposited in the form of an alloy on the cathode while continuing to introduce the chloride into the injector and maintaining the potential difference E2 in such a manner that the potential measured at the monitoring electrode remains in terms of absolute value near the absolute value of the set-point potential; and E2 corresponds to the passage of at least X/2 Faradays per mole of $MCl_x$ introduced into the bath, where M is the least electronegative metal and X is its valence, and that E1 corresponds to the passage of at least ½ Faraday per mole of $MCl_x$.

Hence as in the previous process, the invention includes elements of the three patents referred to above but all in the same pyrogenic electrolytic cell, and it is distinguished from those patents by the fact that a deposit made from metal ions originating in part from anodic dissolution is associated with the deposit of at least one metal by electrolytic reduction of its halide.

It should be noted that since the metals vary widely in terms of their deposit potential, a strong chemical dissolution of the soluble anode takes place in the bath. In order to have the desired concentration of ions in the bath, it is necessary to take this chemical effect into account and to polarize this anode more or less and at the same time to regulate the prereduction of the halide in the injector.

Hence the invention, unlike the previous process, entails the necessity of linking the potential E2 between the sacrificial electrode and the injector with the quantity of chloride introduced. This makes it possible to control the proportion of ions dissolved in the bath and to produce alloys having the desired composition.

This type of process is also applicable to the case of two metals having deposit potentials that are close to one another, but since the chemical dissolution is then relatively slight, it is then necessary to polarize the soluble anode strongly in order to produce the appropriate concentration in the bath.

The two processes lead to the formation on the cathode of a deposit of readily detachable crystals, where the elements are in solid solution and have the physical characteristics according to the invention.

After separation from the cathode, these crystals are washed in water to eliminate the salt present in the bath, and are then converted to ingots by melting with an appropriate apparatus, such as an arc furnace, an induction furnace, electron bombardment furnace, inductive plasma furnace, or arc plasma furnace.

BRIEF DESCRIPTION OF THE DRAWINGS

The invention will be better understood from the accompanying drawings, in which.

DETAILED DESCRIPTION OF THE DRAWINGS

Figure 1:
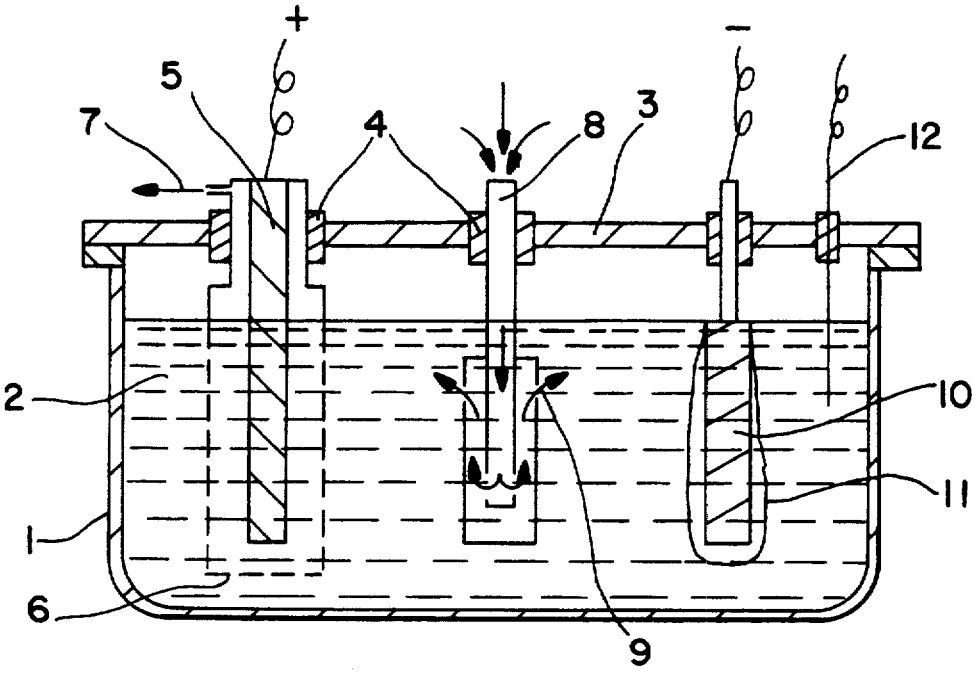
FIG. 1 is a view in cross section of an electrolytic cell for producing alloys whose elements differ in terms of their deposit potential by less than 0.5 V.

In FIG. 1, a vessel 1 contains a bath of molten salts 2, and is closed by a lid 3 that is pierced with openings through which the following elements pass, via electrical insulation rings 4, in order to pass partway into the bath:

- a carbon anode 5, surrounded by a diaphragm 6 and equipped with a tube 7 by which gaseous halogen formed in the electrolysis of the halides escapes, anode 5 connected to the positive pole of a source of direct current;
- a device 8 for feeding gaseous halides which are introduced into the bath in the direction of arrows 9;
- a steel cathode 10 onto which alloy 11 is deposited and which is connected to the negative pole of the current source supplying the anode;
- a measuring electrode 12 connected to a reference electrode, not shown.

Figure 2:
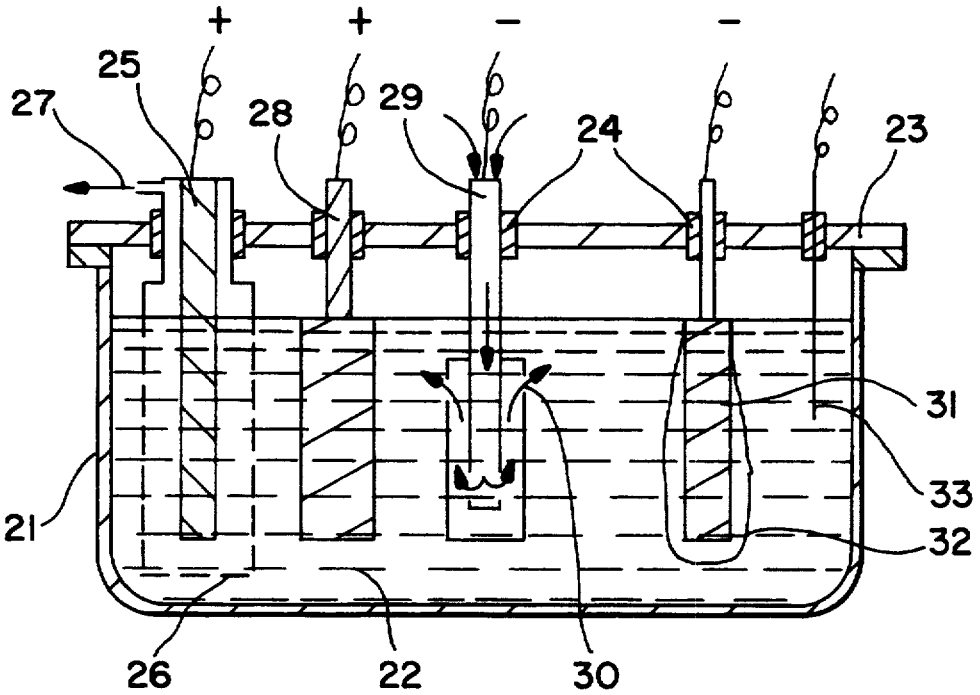
FIG. 2 is a view in cross section of an electrolytic cell for producing alloys whose elements differ in terms of their deposit potential by at least to 0.5 V.

In FIG. 2, an electrolytic cell 21 contains a bath 22 of molten salts, and is closed by a lid 23 pierced with openings through which the following elements pass, by way of rings 24 of insulating material, in order to pass partway into the bath:

- an anode 25 of carbon, surrounded by a diaphragm 26, and equipped with a tube 27 through which the gaseous halogen that is produced in the course of the electrolysis escapes, anode 5 connected to the positive pole of a source of a direct current;
- an expendable electrode 28 constituted by the most electronegative metal of the alloy to be deposited and connected to the positive pole of a source of direct current;
- a device 29 for feeding the halide of the least electronegative metal of the alloy to be deposited, which is introduced into the bath in the gaseous state as indicated by the arrows 30, this device being connected to the negative pole of the current source supplying the expendable electrode;
- a cathode 31 onto which the alloy 32 to be produced is deposited and which is connected to the negative pole of the current source supplying the anode 25;
- a measuring electrode 33, connected to a reference electrode, not shown.

Figure 3:
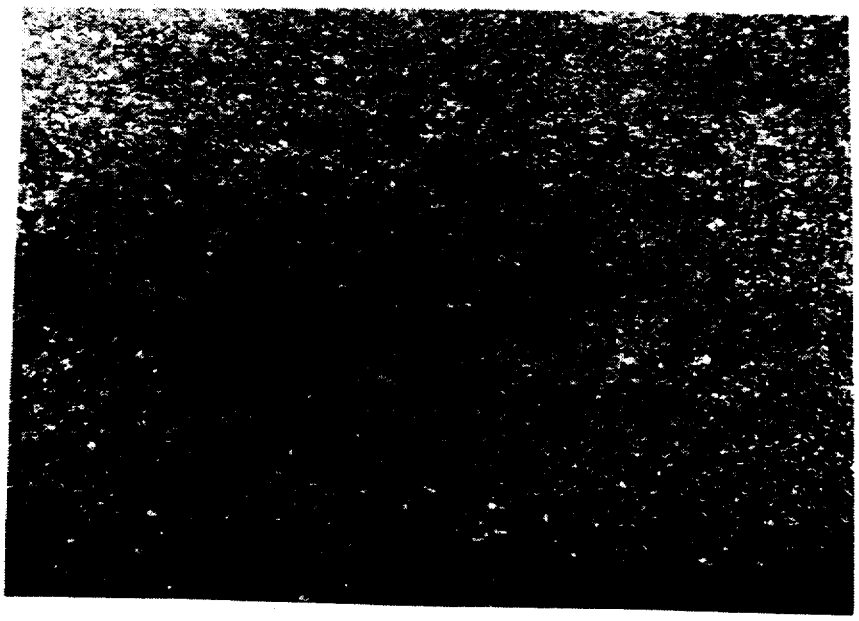
FIG. 3 is a photomacrograph of a $Zr_{70}Hf_{30}$ alloy produced in the prior art from a sponge of zirconium and electrolytic hafnium crystals.

In FIG. 3, black zones indicated by arrows can be seen corresponding to pieces of unmelted hafnium.

Figure 4:
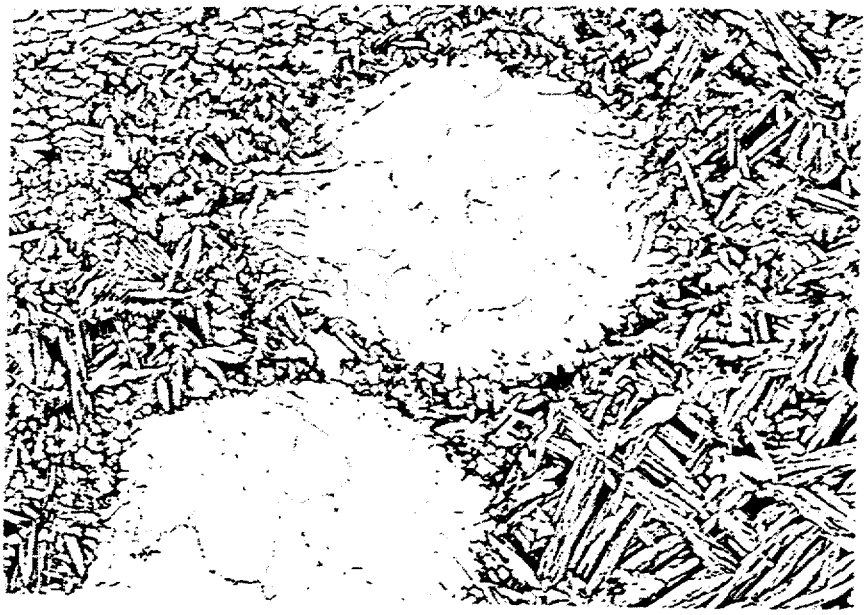
FIG. 4 is a photomicrograph, enlarged 100 times, of the alloy of FIG. 3.

In FIG. 4, white zones can be seen, corresponding to the same unmelted residues.

Figure 5:
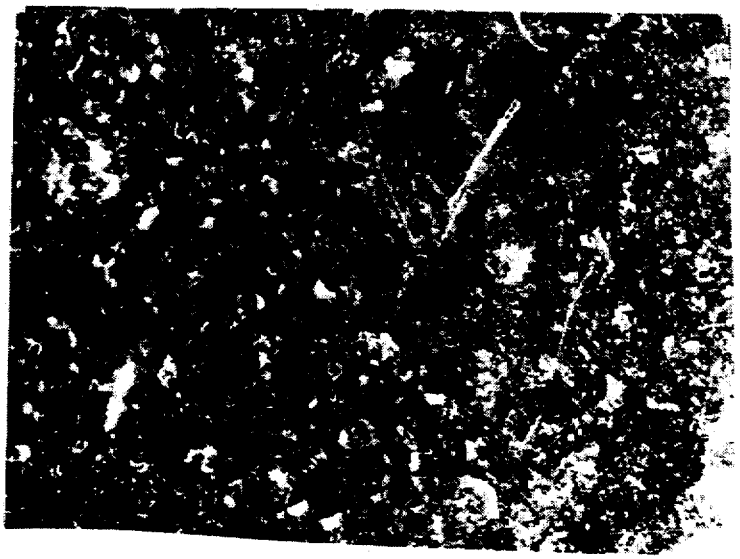
FIG. 5 is a photomicrograph enlarged 3 times of the alloy of FIG. 3, produced by the prior art from a sponge of zirconium and chips of hafnium.

In FIG. 5, white lines can be seen which represent residues of unmelted hafnium chips.

Figure 6:
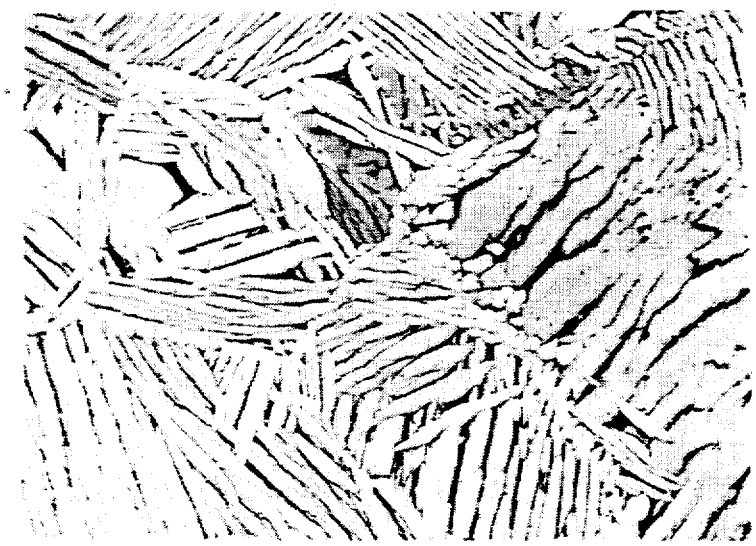
FIG. 6 is a photomicrograph enlarged 500 times of the alloy of FIG. 3, produced in accordance with the invention.

In FIG. 6, the structure of the alloy, produced according to the invention, is completely homogeneous.

Figure 7:
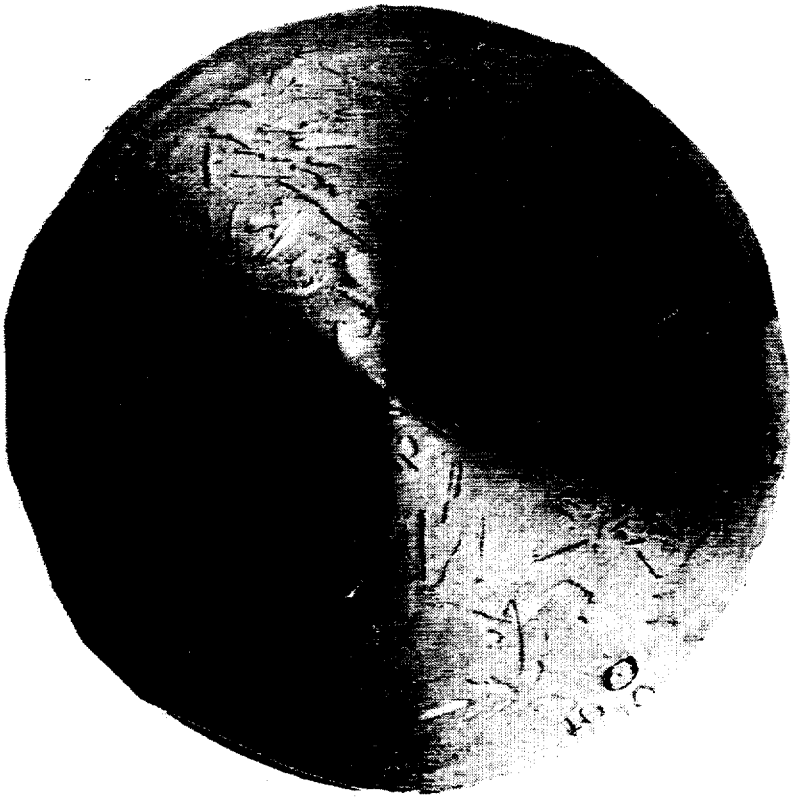
FIG. 7 is a photograph of the cross section of an ingot of an alloy $Nb_{53}Ti_{47}$ produced by the prior art from a sponge of titanium and chips of niobium.

In FIG. 7, the unmelted niobium chips can be seen in black.

Figure 8:
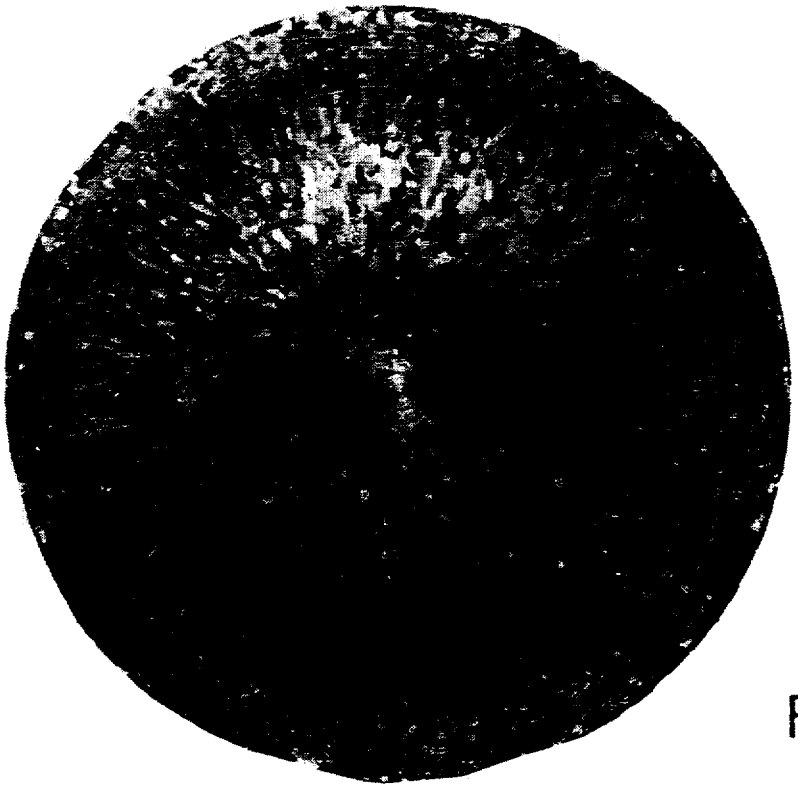
FIG. 8 is a photograph of the cross section of an ingot of the alloy of FIG. 7, but produced in accordance with the invention.

In FIG. 8, in the alloy according to the invention, no presence whatever of unmelted residues can be found.

EXAMPLES

The invention may be illustrated with the aid of the following examples:

Example 1

An electrolytic cell of Inconel 600 containing a bath of molten salts formed of an equimolar mixture of NaCl and KCl plus 3.5% by weight of NaF, heated to 720° C., is equipped with:

- a graphite anode surrounded by a diaphragm of carbon fibers embedded in graphite, by the technique described in U.S. Pat. No. 5,064,513;
- a device for feeding halides, of the type described in French Patent No. 2653139;
- a steel deposit cathode;
- a device for monitoring the potential with respect to a reference electrode, of the type described in U.S. Pat. No. 4,657,643.

A current of 1,500 amperes (hence a current density of 75 mA/cm$^2$) is passed between the anode and the cathode, while a mixture of $ZrCl_4$ and $HfCl_4$ is introduced, by the feeding device, in such a manner as to provide 66.2 wt. % Hf and 33.8 wt. % Zr and a quantity in the bath such that the molar ratio of fluoride to the quantity of metals introduced equals 5, and the reference potential measured at the monitoring device is noted.

The cell is supplied continuously for 10 hours with both electric current and chlorides, in such a manner that the potential measured remains close in absolute value to the absolute value of the set-point potential.

In the course of five successive operations and with a mean Faraday yield of 92%, 87.6 kg of alloys were collected, in which the proportions of metals were as follows:

1 Hf: 60.5%, Zr: 39.5%
2 Hf: 67%, Zr: 33%
3 Hf: 66%, Zr: 34%
4 Hf: 66.5%, Zr: 33.5%
5 Hf: 67%, Zr: 33%

These alloys are present in the form of conglomerates having a mean size of 10 mm and composed of crystals 3 mm in mean diameter, having a specific surface area of 0.03 m$^2$/g, in which the metals are in solid solution.

From the standpoint of purity, the composition of these alloys was:

oxygen: 620 ppm
carbon: <10 ppm
nitrogen: <10 ppm
chlorine: <50 ppm
iron: <20 ppm
chromium: <10 ppm
nickel: <10 ppm hence a purity (Zr+Hf) of near 99.9%.

Example 2

An electrolytic cell was used having the same characteristics as example 1, except:

an NaF content of 2.5%,
a bath temperature of 725° C., and
the presence of a sacrificial titanium electrode polarized positively and electrically connected to the chloride injector polarized negatively.

An equimolar niobium-titanium alloy was made, by feeding the injector with niobium chloride, passing a current of 100 amperes between the anode and the cathode, and passing a current of 20 amperes between the sacrificial electrode and the injector, in such a way as to produce a concentration of metal ions in the bath such that the ratio between the quantity of fluoride and the quantity of dissolved metal in the bath was equal to 6. The reference potential indicated by the monitoring device was then noted. The polarization of the injector was adjusted in such a manner as to pass 5 Faradays per mole of $NbCl_5$ introduced, and that of the cathode was adjusted in such a manner as to pass 2 Faradays per mole of $NbCl_5$, while monitoring the potential of the monitoring device, which remains between −1.85 and −1.95 V.

The concentration of Ti ions in the bath was demonstrated to be kept between 1.5 and 2.5% by weight, with a mean valence of between 2 and 2.3, while the concentration of Nb ions varied between 0.1 and 0.75% by weight for a mean valence of between 3.4 and 3.7.

For a titanium valence equal to 2.15, the material balance is evidence of a chemical attack complimentary to the electrochemical attack and globally represented by the equations:

$$2\ Nb^{5+} + 2e^- \rightarrow 2\ Nb^{4+}$$

$$Ti \rightarrow Ti^{2+} + 2e^-, \text{ hence}$$

$$2\ Nb^{4+} + Ti^{2+} \rightarrow 2\ Nb^{(4-x)+} + Ti^{(2+2x)+}.$$

Under these conditions, with a chloride yield of 95% and a metal yield of 90% for a discharge of 473 g/h, an alloy was produced containing crystals of Nb-Ti in solid solution at an atomic concentration of 50%±10%, the crystals having a mean size of 0.5 mm and a specific surface area of 0.02 $m^2/g$, in the form of 10 mm conglomerates having the following composition:

oxygen: 500 ppm; carbon: 20 ppm; nitrogen: <20 ppm; iron: <20 ppm; chromium: <70 ppm; nickel: <10 ppm; chlorine: <10 ppm; fluorine: <10 ppm; sodium: <10 ppm; potassium: <10 ppm; the remainder being niobium and titanium.

The invention is applicable to the production of alloys of refractory metal of very high purity, which have very good homogeneity on the microscopic scale.

What is claimed is:

1. An alloy comprising at least two refractory metals having melting temperatures differing by at least 200° C., and being present in proportion by weight such that solidification of the alloy begins at a temperature at least 150° C. less than the solidification temperature of the refractory metal of greatest melting point, said alloy being in the form of conglomerates of dimensions between 0.2 and 30 mm, comprising crystals of size 0.1 to 1 mm having a specific surface area between 0.005 and 0.2 $m^2/g$, in which the refractory metals are in a solid solution state such that said crystals are homogeneous on the atomic scale, said alloy being capable of conversion into a homogeneous ingot with purity about 99.9% by weight.

2. Alloy of claim 1, wherein the crystals have a specific surface area of between 0.01 and 0.05 $m^2/g$.

3. Alloy of claim 1, wherein the conglomerates have dimensions of between 1.5 and 12 mm.

4. Alloy of claim 1, wherein the refractory metals are selected from the group consisting of Hf, Zr, Ti, Nb and Ta.

5. Alloy of claim 1 which is selected from the group consisting of Hf-Zr, Hf-Ti, Nb-Ti, Nb-Zr, Ta-Ti, Ta-Zr, Ta-Nb, Nb-Ta-Ti and Nb-Ti-Al.

* * * * *